United States Patent [19]

Prewer et al.

[11] Patent Number: 4,942,402

[45] Date of Patent: Jul. 17, 1990

[54] RADIATION ABSORBER AND METHOD OF MAKING IT

[75] Inventors: Brian E. Prewer; Brian Milner, both of Wells, England

[73] Assignee: Thorn Emi Electronics Limited, Hayes, England

[21] Appl. No.: 262,798

[22] Filed: Oct. 26, 1988

[30] Foreign Application Priority Data

Oct. 27, 1987 [GB] United Kingdom ..... 8725110

[51] Int. Cl.[5] ..... H01Q 17/00

[52] U.S. Cl. ..... 342/1; 342/4

[58] Field of Search ..... 342/1, 4

[56] References Cited

U.S. PATENT DOCUMENTS

| | | | |
|---|---|---|---|
| 3,680,107 | 7/1972 | Meinke et al. | 342/1 |
| 3,836,967 | 9/1974 | Wright | 342/4 |
| 3,887,920 | 6/1975 | Wright et al. | 342/1 |
| 4,006,479 | 2/1977 | LaConbe | 342/1 |
| 4,023,174 | 5/1977 | Wright | 342/4 |
| 4,024,318 | 5/1977 | Forster et al. | 342/1 |
| 4,164,718 | 8/1979 | Iwasaki | 342/4 |
| 4,173,018 | 10/1979 | Dawson et al. | 342/1 |
| 4,353,069 | 10/1982 | Handel et al. | 342/1 |
| 4,496,950 | 1/1985 | Hemming et al. | 342/4 |
| 4,539,433 | 9/1985 | Ishino et al. | 342/1 |

OTHER PUBLICATIONS

"Submillimeter and Millimeter Wave Characterization of Absorbing Materials", by Hamid Hemmati et al., Applied Optics, vol. 24, No. 24, 12/15/85, pp. 4489–4492.

*Primary Examiner*—Thomas H. Tarcza
*Assistant Examiner*—Mark Hellner
*Attorney, Agent, or Firm*—Fleit, Jacobson, Cohn, Price, Holman & Stern

[57] ABSTRACT

An absorber for radiation of frequency of the order of 1 THz is formed of a body of cured silicone-based elastomer containing an inert, powdered siliceous filler. Both the elastomer and the filler are electrically insulating and the surface of the absorber that is exposed to the radiation is preferably profiled to enhance absorption of the radiation. The profiling preferably takes the form of an array of sharp-pointed pyramids having rectangular or triangular bases. A method of moulding such absorbers is also disclosed.

4 Claims, 2 Drawing Sheets

RADIATION ABSORBER AND METHOD OF MAKING IT

This invention relates to radiation absorbers and in particular to radiation absorbers suitable for use with radiation having a frequency of the order of 1 THz ($10^{12}$ Hz, 0.3 mm wavelength).

Radiation absorbers are used for mode control in microwave cavities and tubes and in waveguides. They are also used for protecting radio equipment from interference and vehicles from detection. The conventional microwave absorbers increase in reflectivity as the radiation frequency is increased.

One known method of reducing the reflectivity of an absorbent material is to profile the irradiated surface (e.g. to form an array of pyramids) thus producing multiple reflections and enhancing the absorption of the incident radiation. However, the conventional microwave absorbers are not, in general, suitable for absorbing radiation having a frequency above 300 GHz (wavelength less than 1 mn).

Figure 2A:
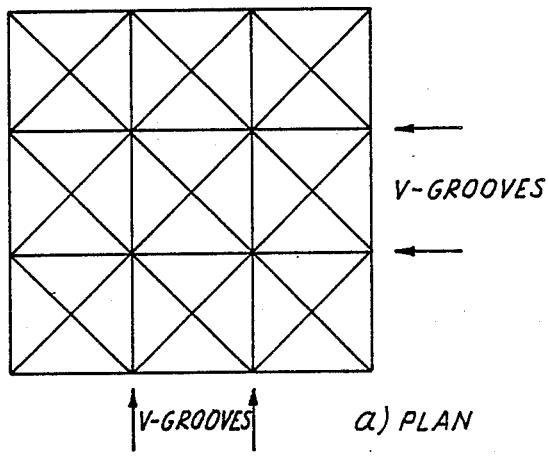
Figure 2B:
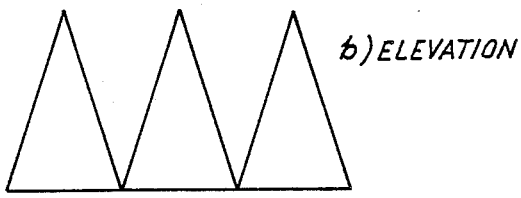

The characteristics over the frequency range 35 GHz–3 THz of a series of iron-loaded, cast epoxy absorber materials, have been published by Hemmati, H et al (Applied Optics, Vol. 24, No. 24, 15th December, 1985, pp 4489–4492). FIG. 2 of Hemmati's paper shows that with a radiation frequency of 1 THz, the reflection loss lies between about 4 dB and 11 dB, which in some circumstances may not be sufficient. Furthermore, the materials in question are rather viscous and cannot easily be moulded to provide a steeply profiled surface with sharp angles.

One object of the present invention is to provide a radiation absorber having a high reflection loss when irradiated at a frequency in the range 0.5–2.5 THz.

Another object of the present invention is to provide a radiation absorbent material suitable for absorbing irradiation in the frequency range 0.5–2.5 THz, the material having a sufficiently low viscosity to facilitate moulding to provide the required profile.

Accordingly, there is provided a radiation absorber for absorbing radiation in the frequency range 0.5–2.5 THz comprising:

a body of cured, electrically insulating, silicone-based elastomer containing an inert, electrically insulating, powdered siliceous filler, the surface exposed to the radiation being profiled to enhance the absorption of said radiation by said absorber and to reduce the reflectivity in the said frequency range.

Usefully, the silicone-based elastomer with an inert siliceous filler comprises "Silcoset 100", which is cured by mixing with "Curing Agent A", both materials being manufactured by Imperial Chemical Industries, p.l.c.

The profiled surface of the elastomer conveniently comprises either two or three mutually inclined sets of parallel V-grooves arranged to provide an array of sharp-pointed pyramids having bases shaped as either parallelograms (preferably square) or triangles (preferably equilateral). It is desirable that flat regions between the pyramids and at their apexes should be completely eliminated.

In another aspect of the invention, a mould suitable for manufacturing a sheet of profiled radiation absorbent material comprises a mould with an appropriately profiled base, the mould being made of cured silicone based elastomer filled with an inert siliceous filler, and the inner surface of the mould being treated to prevent damage to the profiled sheet during the extraction from the mould.

The inventors have discovered that a silicone-based elastomer containing an inert siliceous filler, after curing, provides an excellent absorber of radiation in the frequency range 0.5–2.5 THz, and that this material has a sufficiently low viscosity before curing to enable it to be moulded to give the required profile.

Figure 1:
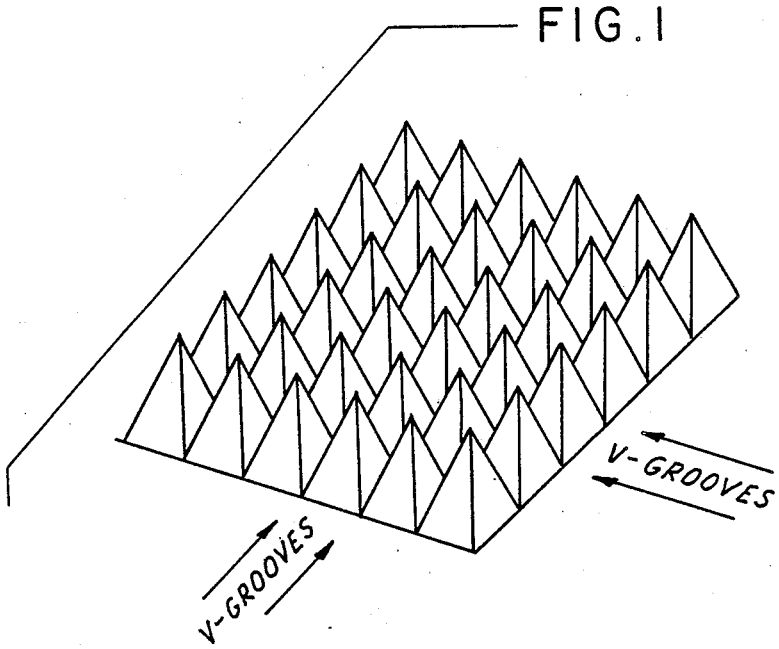

The invention will now be described in greater detail with reference to the accompanying drawings of which:

FIG. 1 shows a general view of an array of square-based pyramids

FIGS. 2(*a*) and (B) show plan and elevation views of the array of FIG. 1.

Figure 3:
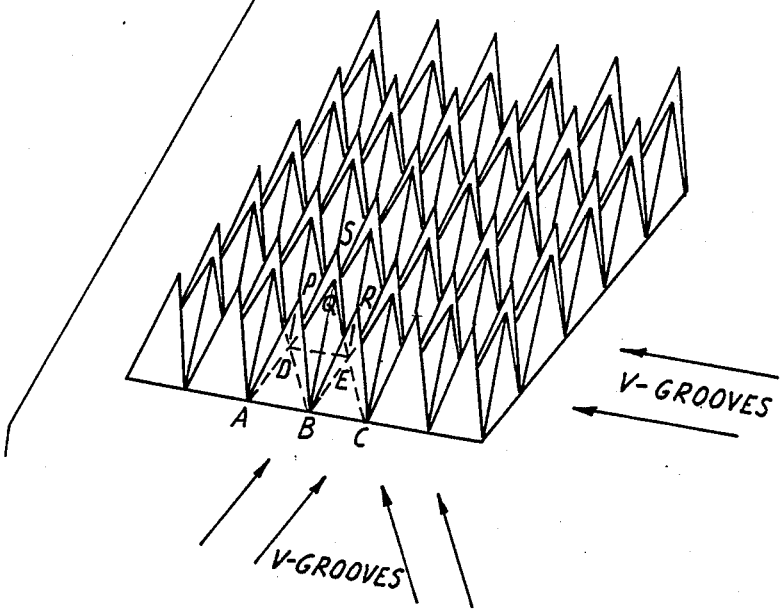

FIG. 3 shows a general view of an array of triangular-based pyramids

Figure 4A:
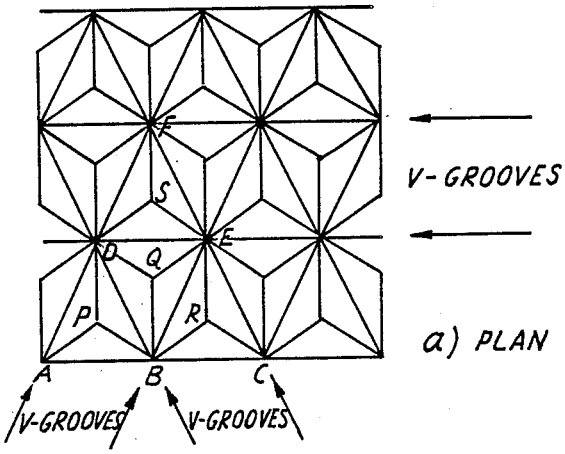
Figure 4B:
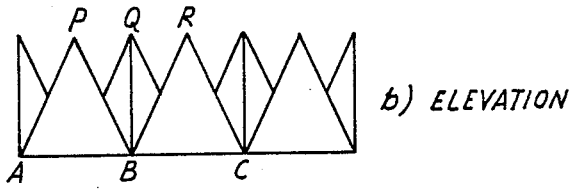

FIG. 4(*a*) and (*b*) show plan and elevation views of the array of FIG. 3.

The inventors have discovered that a flat surface of cured Silcoset 100 has a reflection loss of 15 dB for a radiation frequency of 1.0 THz, which compares favourably with the 11 dB reflection loss of the best material, described by Hemmati et al and discussed hereinbefore. The inventors have also found that a preferred profile geometry for high reflection loss at a frequency between 0.5 and 2.5 THz comprises an array of square based pyramids of height between 1.0 and 3.0 mm with the four triangular faces each inclined at 25°–30° to the pyramid axis. At a frequency of 1.5 THz the pyramids are preferably 2.0 mm high with the triangular faces each inclined at 25° to the pyramid axis. Measurements on cured Silcoset 100 with this profile are given in the table. The measurements show that over the frequency range 0.7–2.5 THz with angles of incidence between 0° and 45°, the reflection loss varies between 26 and 44 dB, giving a considerable improvement over the 11 dB reflection loss of the best previously known material.

TABLE

| Angle of incidence (deg.) | Reflection loss (dB) at a frequency of: 693 (GHz) | 890 (GHz) | 1.6 (THz) | 2.5 (THz) |
|---|---|---|---|---|
| 0 | | 33 | | |
| 20 | 39 | 35 | 28 | 27 |
| 45 | 38 | 42 | 30 | 26 |
| 75 | 16 | 21 | 25 | 22 |

FIG. 1 shows a general view and FIGS. 2(*a*) and 2(*b*) plan and elevation views of an array of square based pyramids formed by two orthogonal sets of parallel V-grooves, which are indicated by the arrows. In one example of the invention, a readily machined material such as perspex is profiled to the shape shown in FIG. 1 by machining two perpendicular sets of parallel V-grooves arranged to provide sharp pointed pyramids 2.0 mm high with the side faces of the pyramids inclined at 25° to the pyramid axis. This model is used for forming a mould of Silcoset 100 cured with Curing Agent A. The inside of the mould is coated with a metal layer such as vacuum evaporated aluminum to prevent sticking and damage. Sheets of the profiled radiation absorbent material can be repeatedly produced by pouring Silcoset 100 mixed with the Curing Agent A into the mould, allowing the Silcoset 100 to be cured and then removing it from the mould.

In general, two parallel sets of V-grooves can be arranged to provide pyramids having bases in the shape of any parallelogram. In another example, shown in FIG. 3, three sets of parallel V-grooves are used to form sharp-pointed triangular based pyramids. Plan and elevation views of this arrangement are shown in FIGS. 4(*a*) and 4(*b*) respectively. An example of the arrangement in FIG. 3 is illustrated by considering the four pyramids PABD, QDEB, RBCE and SDEF, as shown also in FIGS. 4(*a*) and 4(*b*). The apexes are P, Q, R, S and the triangular bases are ABD, DBE, BCE, DEF respectively. Thus the pyramid QDBE has common edges BD with pyramid PABD, BE with pyramid RBCE and DE with pyramid SDEF. For high reflection loss at 1.5 THz the pyramids should preferably be 2.0 mm high and the pyramid side faces should be inclined at 25° to the pyramid axis.

A radiation absorber according to the invention is highly effective for radiation of frequencies between 0.5 and 2.5 THz. It is easily manufactured from readily available materials by cold setting in a mould. It is easily cut to any required shape and is sufficiently flexible to be attached to non-flat surfaces.

We claim:

1. A radiation absorber designed to absorb radiation in the frequency range 0.5–2.5 THz comprising a body of cured, electrically insulating, silicone-based elastomer containing a n inert, electrically insulating, powdered siliceous filler, the surface of said absorber exposed to the radiation being profiled to enhance the absorption of said radiation by said absorber and thus to reduce the reflectivity of said absorber to said radiation in the said frequency range, wherein said electrically insulating silicone-based elastomer comprises a room temperature polymerising aromatic/aliphatic hydrocarbon substituted polysiloxane.

2. A radiation absorber according to claim 1 wherein the profiling of said exposed surface of said absorber conforms to an array of sharp-pointed pyramids.

3. A method of making a radiation absorber designed to absorb radiation in the frequency range 0.5–2.5 THz comprising the steps of;

forming a mould bearing a surface pattern complementary to a surface profile to be imposed upon said absorber;

making a mixture of an electrically insulating, silicone-based elastomer comprising a room temperature polymerising aromatic/aliphatic hydrocarbon substituted polysiloxane with an inert, electrically insulating, powdered siliceous filler and a curing agent, placing said mixture in said mould and allowing curing to take place, and removing the cured mixture from the mould.

4. A method according to claim 3 wherein the formation of said mould includes the steps of:

machining into the surface of a substrate material a pattern of deformations corresponding to the surface profile to be imposed upon said absorber, forming said mould against the machined surface of said substrate material, and coating the said surface pattern of said mould with a metal layer to facilitate the release of moulded and cured material from said mould.

* * * * *